US007784387B2

(12) United States Patent
Dale et al.

(10) Patent No.: US 7,784,387 B2
(45) Date of Patent: Aug. 31, 2010

(54) LAMINATED SAWHEAD CONSTRUCTION

(75) Inventors: Peter H. Dale, Orillia (CA); Luc Belzile, Petit-Shippigan (CA)

(73) Assignee: Norwood Industries Inc. (CA)

( * ) Notice: Subject to any disclaimer, the term of this patent is extended or adjusted under 35 U.S.C. 154(b) by 251 days.

(21) Appl. No.: 11/005,186

(22) Filed: Dec. 6, 2004

(65) Prior Publication Data

US 2006/0117926 A1 Jun. 8, 2006

(51) Int. Cl.
*B26D 1/18* (2006.01)

(52) U.S. Cl. ..... 83/485; 83/745; 83/859

(58) Field of Classification Search ..... 83/485, 83/167, 743, 745, 471, 483, 821, 651, 824, 83/825, 859, 860; 144/286.1
See application file for complete search history.

(56) References Cited

U.S. PATENT DOCUMENTS 2,852,050 A * 9/1958 Horstmann et al. ..... 144/92
3,151,642 A * 10/1964 Olson ..... 83/486.1
3,565,139 A * 2/1971 Olson et al. ..... 83/859
3,866,496 A * 2/1975 Payne et al. ..... 83/471.3
3,889,560 A * 6/1975 MacFadyen ..... 83/872
4,494,431 A * 1/1985 Niswonger ..... 83/471.3
4,780,030 A * 10/1988 Zudall ..... 408/88
4,784,192 A * 11/1988 Raggiotti ..... 144/35.2
5,213,022 A * 5/1993 Elgan ..... 83/797
5,582,088 A * 12/1996 Harter ..... 83/468.4
6,539,992 B1 * 4/2003 Nuss ..... 144/135.3
6,722,248 B1 * 4/2004 Johnston, Sr. ..... 83/795
2003/0024371 A1 * 2/2003 Gibson et al. ..... 83/795

* cited by examiner

*Primary Examiner*—Boyer D. Ashley
*Assistant Examiner*—Phong Nguyen
(74) *Attorney, Agent, or Firm*—K&L Gates LLP

(57) ABSTRACT

A kit for constructing a sawhead comprises a pair of plates adapted to be stacked upon and secured to one another by bolts to form a plate stack. The kit further comprises a pair of elongate guide receivers. Each guide receiver has a longitudinal axis and an interior wall which defines a bore extending through the each guide receiver and through which bore the longitudinal axis extends. The interior wall has a cross-section which is substantially constant along the length of each guide receiver. The guide receivers are adapted to be mounted to the plate stack by bolts at respective operative positions whereat the longitudinal axes are oriented parallel to one another and whereat the guide receivers are spaced from one another in a direction transverse to the axes.

19 Claims, 3 Drawing Sheets

LAMINATED SAWHEAD CONSTRUCTION

FIELD OF THE INVENTION

The present invention relates to the field of band sawmills, and more particularly, to a sawmill construction.

BACKGROUND OF THE INVENTION

A band sawmill typically includes four main components, namely, a bed, a carriage and a sawhead. The bed is adapted to receive a log, such that the log, when received, extends horizontally. The carriage is mounted to the bed for horizontal movement along the length of the log and has vertical guide rods attached thereto. The sawhead is mounted to the guide rods for vertical movement relative to the carriage, and for horizontal movement with the bed. The saw is mounted to the sawhead for movement therewith, to cut the log.

To accommodate and support the weight of the engine, bandwheels, blades and other components required for sawing, sawheads are typically relatively large, complex and heavy structures constructed of heavy gauge steel utilizing multiple precision welds. As well, to avoid binding, which would interfere with smooth vertical movement, the sawhead is typically mounted to the guide rods with bearings, low-friction plastic bushings or the like, to facilitate smooth vertical movement. The requirement for heavy gauge steel and precision welds, and the presence of bearings or the like adds costs, which is undesirable.

SUMMARY OF THE INVENTION

The present invention provides for a band sawmill wherein: (i) the use of multiple precision welds in the sawhead, (ii) the need for heavy gauge steel or the like and (iii) the use of bearings or the like for mounting the sawhead to the carriage, can be minimized or avoided.

A kit for constructing a sawhead for use as part of a sawmill forms one aspect of the invention. The sawmill is of the type having a bed, a carriage and a pair of elongate guide members. The bed defines a first translation axis. The carriage is mounted to the bed for movement along the first translation axis and defines a second translation axis and a lateral axis. The second translation axis is orientated transverse to the first translation axis and the lateral axis is orientated transverse to each of the first translation axis and the second translation axis. The guide members are secured to the carriage for movement therewith along the first translation axis, the guide members each being orientated parallel to the second translation axis and being spaced apart from one another in the direction of the lateral axis. The kit comprises a pair of guide receivers and a pair of plates. Each guide receiver is mounted in use to a respective one of the guide members for movement therealong parallel to the second translation axis. The plates of the pair are stacked upon and secured to one another in use to form a plate stack, the plate stack being secured in use to each of the guide receivers to permit reciprocating movement of said plate stack along the second translation axis.

An improved sawmill forms another aspect of the invention. The sawmill is of the type having a bed and a carriage. The bed defines a first translation axis. The carriage is mounted to the bed for movement along the first translation axis and defines a second translation axis and a lateral axis. The second translation axis is orientated transverse to the first translation axis. The lateral axis is orientated transverse to each of the first translation axis and the second translation axis. The improvement comprises a pair of elongate guide members and a sawhead. The guide members are secured to the carriage for movement therewith along the first translation axis, the guide members each being orientated parallel to the second translation axis and being spaced apart from one another in the direction of the lateral axis. The sawhead comprises a pair of guide receivers and a pair of plates. Each guide receiver is mounted in use to a respective one of the guide members for movement therealong parallel to the second translation axis. The plates are stacked upon and secured to one another to form a plate stack, the plate stack being secured to each of the guide receivers to permit, in use, reciprocating movement of said plate stack along the second translation axis.

A kit for constructing a sawhead forms another aspect of the invention. The kit comprises a pair of plates and a pair of elongate guide receivers. The pair of plates are adapted to be stacked upon and secured to one another by bolts to form a plate stack. Each guide receiver has a longitudinal axis and an interior wall which defines a bore extending through said each guide receiver and through which bore said longitudinal axis extends. The interior wall has a cross-section which is substantially constant along the length of said each guide receiver. The guide receivers are adapted to be mounted by bolts to the plate stack at respective operative positions whereat the longitudinal axes are oriented parallel to one another and whereat the guide receivers are spaced from one another in a direction transverse to said axes.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinafter.

DETAILED DESCRIPTION

Figure 1:
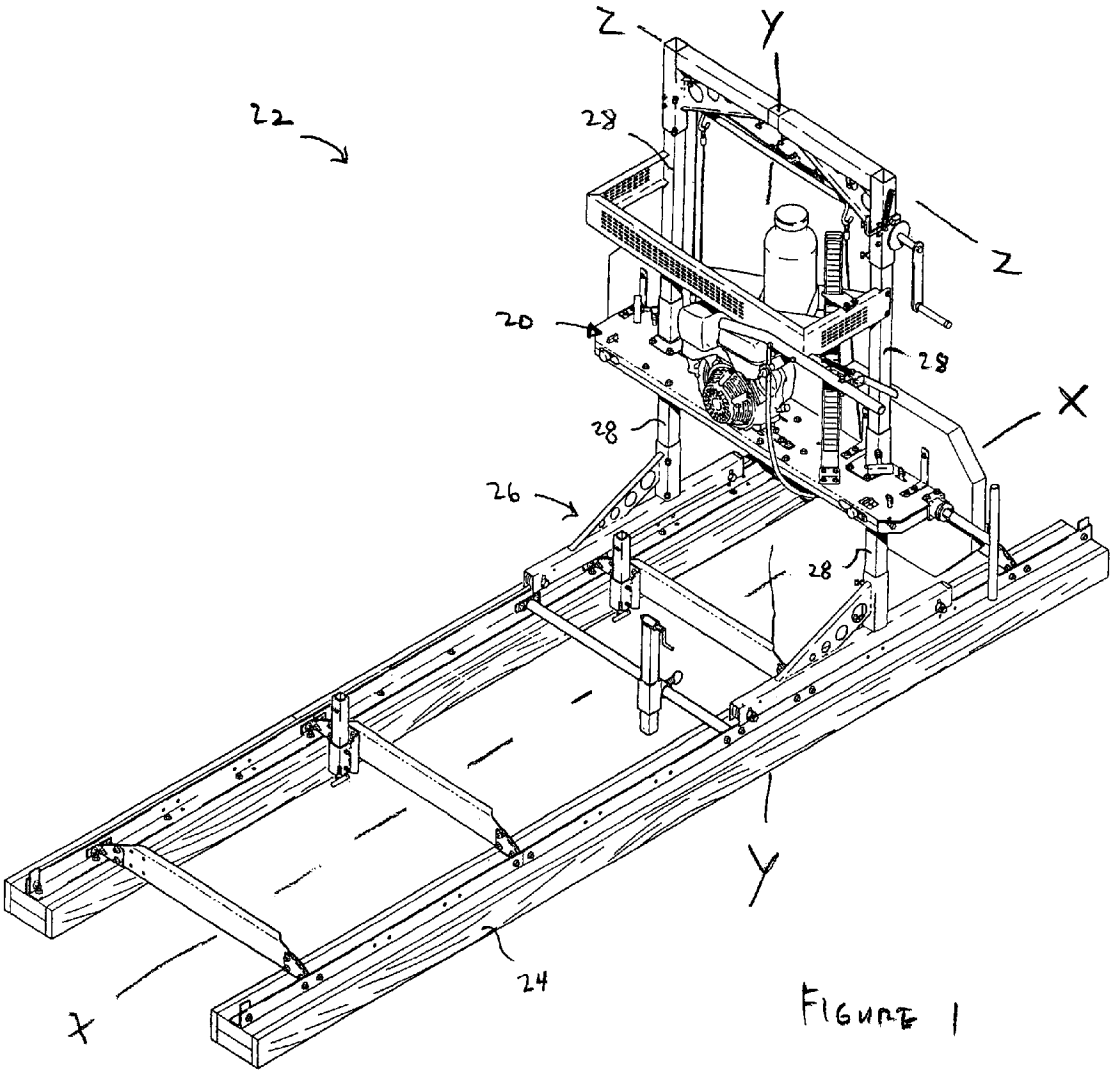
FIG. 1 is a perspective view of an improved sawmill constructed using a sawhead according to a preferred embodiment of the present invention
Figure 2:
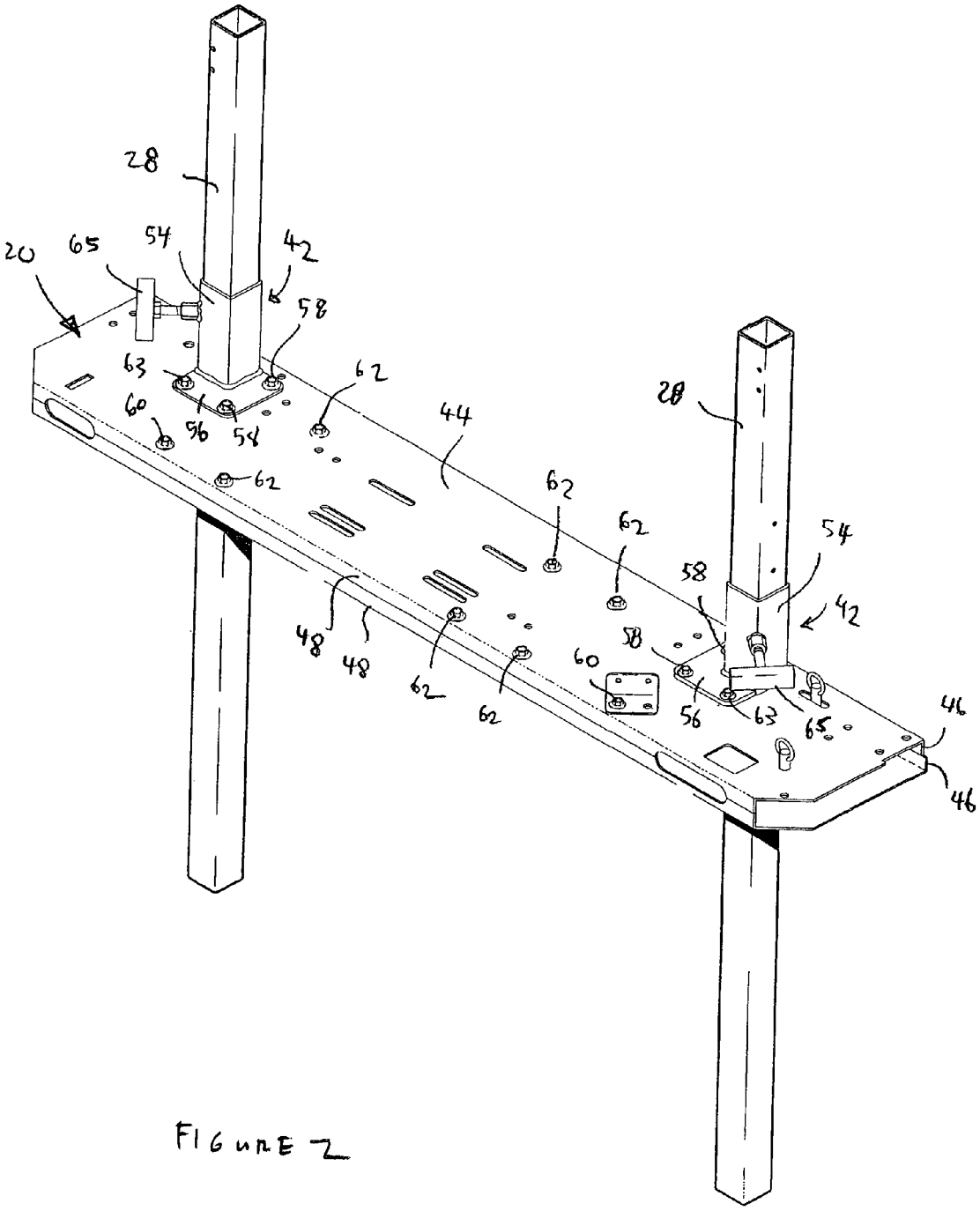
FIG. 2 is an enlarged view of a portion of the structure of FIG. 1

With general reference to FIG. 1, a sawhead according to a preferred embodiment of the present invention is illustrated in use as part of an improved band sawmill, the sawhead and sawmill being designated in the illustration respectively with general reference numerals 20 and 22.

With particular reference first to the sawmill 22, it will be seen to be of a type having, in addition to the sawhead 20, a bed 24, a carriage 26 and a pair of elongate guide rod tubes 28, hereinafter referred to as guide members.

The bed 24 and carriage 26 of the sawmill 22 illustrated are of conventional construction. Accordingly, they are described hereinafter only briefly, for the purposes of clarity in the description of the invention which follows.

The bed 24 defines a first translation axis X-X.

The carriage 26 is mounted to the bed 24 for movement along the first translation axis X-X and defines a second translation axis Y-Y and a lateral axis Z-Z. The second translation axis Y-Y is orientated transverse to the first translation axis X-X and the lateral axis Z-Z is orientated transverse to each of the first translation axis X-X and the second translation axis Y-Y.

The sawhead 20 and the guide members 28 as illustrated are now hereinafter fully described.

The guide members 28 are close-tolerance tube material with smooth welds/seams, are substantially rectangular in cross-section and are secured to the carriage 26 for movement therewith along the first translation axis X-X.

Each guide member 28 is vertically orientated, parallel to the second translation axis Y-Y, and the guide members 28 are spaced apart from one another horizontally, in a direction transverse to the orientation of the guide members, specifically, in the direction of the lateral axis Z-Z.

Figure 3:
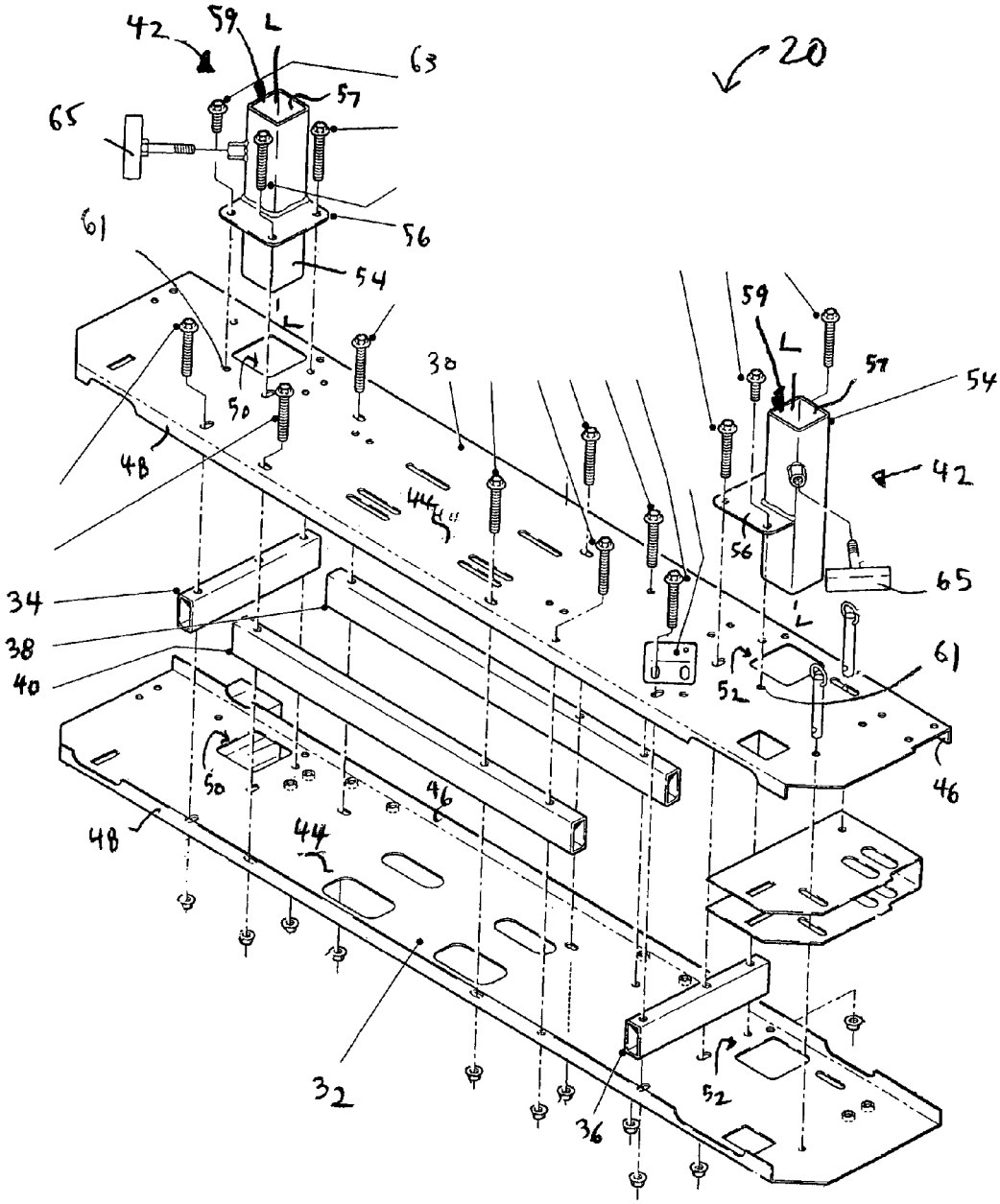
FIG. 3 is an exploded view of the sawhead of FIG. 2.

The sawhead 20, as best seen in FIG. 3 wherein it is depicted in exploded perspective, comprises a pair of plates 30,32, a plurality of reinforcing members 34,36,38,40 and a pair of elongate guide receivers 42. By using several layers of thin sheets or plates, the sawhead comprises a laminated structure which is sturdy and lightweight. This allows the remainder of the sawmill to be constructed out of relatively lightweight materials, as compared to sawheads of the prior art.

Each plate 30,32 has a central planar portion 44, a first flange 46 and a second flange 48, the first flange 46 and the second flange 48 each extending substantially normal from the central body portion 44 in a common direction and from opposite sides thereof. Each plate 30,32 further has a pair of apertures 50,52. The pair of plates 30,32 are stacked upon one another to form a plate stack. In the plate stack, the first flanges 46,46 of each of the plates 30,32 extend to, are aligned with and abut one another and the second flanges 48,48 of each of the plates 30,32 extend to, are aligned with and abut one another. Further, the apertures 50,52 align in the plate stack to form a pair of laterally spaced-apart throughpassing sockets 50,50 and 52,52.

The plurality of reinforcing members 34,36,38,40 are tube material of substantially rectangular cross-section and are hereinafter referred to alternatively as reinforcing members or reinforcing tubes. The plurality includes a first pair of tubes 34,36 and a second pair of tubes 38,40 which are sandwiched between the pair of plates 30,32 in the plate stack. Each of the tubes 34,36 in the first pair is orientated parallel to the first translation axis X-X and the tubes 34,36 are spaced apart from one another in the direction of the lateral axis Z-Z. Each of the tubes 38,40 in the second pair are disposed between the first pair 34,36 and orientated parallel to the lateral axis Z-Z, and the tubes 38,40 are spaced apart from one another in the direction of the first translation axis X-X.

The first flanges 46,46 of each of the plates 30,32 lie against one end of each of the first pair of reinforcing tubes 34,36 and the second flanges 48,48 of each of the plates 30,32 lie against the other end of each of the first pair of reinforcing tubes 34,36. The first flanges 46,46 of each of the plates 30,32 further lie against one side of one 38 of the second pair of reinforcing tubes. This relation of the reinforcing tubes 34,36, 38,40 and plates 30,32, and specifically, the support provided by flanges 46,48 and tubes 34,36,38,40 to one another, provides additional strength in the plate stack.

The guide receivers 42 each comprise an elongate main body member 54 and a mounting flange 56 extending around at least a portion of the periphery of the main body member 54 at a longitudinally intermediate position. The main body member 54 has a longitudinal axis L-L and an interior wall 57 which defines a bore 59 extending through said each guide receiver 42. The interior wall 57 has a cross-section which is substantially constant along the length of said each guide receiver 42. As illustrated, the main body member 54 is close-tolerance tube material of substantially rectangular cross-section. Each guide receiver 42 has and is disposed at an operative position whereat its main body member 54 is disposed in close-fitting relation in a respective socket 50,50 or 52,52 and its mounting flange 56 is disposed flush against a respective one of the plates 30,32. At the operative positions, the axes L-L of the guide receivers 42 are orientated parallel to one another and the guide receivers are spaced from one another in a direction transverse to their axes L-L.

The plates 30,32 of the plate stack are secured to one another, and the plate stack is secured to each of the pair of guide receivers 42, by nut and bolt assemblies 58,60,62. Some of the nut and bolt assemblies 58 pass through the mounting flanges 56 of the guide receivers 42, the plates 30,32 and the reinforcing tubes 34,36 of the first pair; other nut and bolt assemblies 60 pass only through the plates 30,32 and the reinforcing tubes 34,36 of the first pair; and yet others of the nut and bolt assemblies 62 pass through the plates 30,32 and the reinforcing tubes 38,40 of the second pair. Bolts 63 are also provided, which extend through the mounting flanges 56 to engage plate 30 by threaded engagement with threaded holes 61 formed therein.

Each guide receiver 42 is mounted to a respective one of the pair of guide members 28 for movement therealong parallel to the second translation axis Y-Y. Such mounting is accommodated by fitting the guide members 28 through the main body members 54 for direct sliding contact. This mounting, in turn, permits reciprocating movement of said plate stack along the second translation axis Y-Y. A handle 65 is threaded into each body member 54, and can be engaged to bear against guide members 28 to fix the vertical position of the sawhead 20.

It is noted that the sawmill illustrated does not employ bearings, low-friction plastic bushing or the like, to facilitate sliding action of the sawhead 20. Further, the sawmill does not employ multiple precision welds. This permits the construction of a relatively inexpensive sawmill, even at relatively low manufacturing volumes.

The components of the sawhead, and indeed, the entire sawmill, can be packaged in kit form and shipped to a purchaser for assembly. This can further lessen costs, rendering the kit product an attractive option to average people seeking to purchase a personal, portable sawmill, as is becoming increasingly popular.

While but a single embodiment of the present invention has been herein shown and described, it will be understood that various changes may be made without departing from the spirit or scope of the invention.

As one example, whereas reinforcing tubes are provided in the preferred embodiment illustrated for the purposes of stiffening the plate stack, the plates could be stamped with integral stiffening ribs (not shown) to similar effect. Alternatively, non-tubular stamped metal inserts could be utilized (also not shown), as could solid bars. Moreover, whereas the reinforcing members illustrated herein are of rectangular cross-section, other cross-sections, such as trapezoidal and obround could readily be utilized. The location, configuration and quantity of reinforcing members could vary.

As well, whereas the guide members and main body members illustrated are of rectangular cross-section, numerous other constant-cross section geometries could be employed. Notably, but without limitation, guide members of constant circular cross-section could readily deployed in conjunction with cylindrical main body members.

Further, whereas bolts, both in nut and bolt assemblies and alone are utilized in the preferred embodiment illustrated to hold the plates, guide receivers and reinforcing tubes together, other fastening mechanisms could also be used. Without limitation, appropriate threaded apertures could, for example, be formed in one or more of the plates and/or in the mounting flanges to receive bolts, thereby to obviate the need for nuts.

Various materials, such as steel, can be used for the construction of the sawhead and the guide members.

Yet further modifications are possible. Accordingly, the invention should be understood as being limited only by the claims appended hereto, purposively construed.

The invention claimed is:

1. An improved sawmill having:

a bed defining a first translation axis: and a carriage, the carriage being mounted to the bed for movement along the first translation axis; and defining a second translation axis and a lateral axis, the second translation axis being orientated transverse to the first translation axis and the lateral axis being orientated transverse to each of the first translation axis and the second translation axis, wherein the improvement comprises:

two or more elongate guide members secured to the carriage for movement therewith along the first translation axis, the guide members each being orientated parallel to the second translation axis and being spaced apart from one another in the direction of the lateral axis; and a sawhead, the sawhead comprising:

two or more guide receivers, each guide receiver being mounted to a respective one of the pair of guide members;

two or more plates extending parallel to said first translational axis, said plates stacked upon and secured to one another to form a plate stack, the plate stack being secured to each of the two or more guide receivers; and one or more reinforcing members sandwiched between the plates in the plate stack and secured to the plates.

2. An improved sawmill according to claim 1, wherein the plates are secured to one another by bolts, the reinforcing members are secured to the plates by bolts and the plate stack is secured to each of the two or more guide receivers by bolts.

3. An improved sawmill according to claim 1, further comprising a plurality of reinforcing members, said plurality of reinforcing members including a first pair of reinforcing members and a second pair of reinforcing members which are sandwiched between the pair of plates in the plate stack and secured to the plates, the first pair being orientated parallel to the first translation axis and spaced apart from one another in the direction of the lateral axis and the second pair being disposed between the first pair, orientated parallel to the lateral axis and spaced apart from one another in the direction of the first translation axis.

4. An improved sawmill according to claim 3, wherein the reinforcing members are reinforcing tubes of rectangular cross-section.

5. An improved sawmill according to claim 4, wherein each plate has a central planar portion, a first flange and a second flange, the first flange and the second flange each extending from the central body portion in a common direction and from opposite sides thereof; and the first flanges of each of the plates extend toward and are aligned with one another and the second flanges of each of the plates extend toward and are aligned with one another.

6. An improved sawmill according to claim 5, wherein the first flanges of each of the plates lie against one end of each of the first pair of reinforcing tubes, the second flanges of each of the plates lie against the other end of each of the first pair of reinforcing tubes and the first flanges of each of the plates lie against one side of one of the second pair of reinforcing tubes.

7. An improved sawmill according to claim 1, wherein the plates are provided with apertures which align in the plate stack to form a pair of laterally spaced-apart throughpassing sockets; and the guide receivers each comprise an elongate main body member and a mounting flange extending around at least a portion of the periphery of the main body member at a longitudinally intermediate position;

and wherein each guide receiver is disposed at an operative position whereat its main body member is disposed in close-fitting relation in a respective socket and its mounting flange is disposed flush against a respective one of the plates, a plurality of bolts secure the plate stack to each of the pair of guide receivers, each bolt passing through a respective mounting flange, thence through the plate against which the mounting flange is disposed, thence through a respective one of the one or more reinforcing members and thence into the other of the plates.

8. An improved sawmill according to claim 7, wherein the main body member is a tube of substantially constant cross-section and each guide member is a tube of constant cross-section.

9. An improved sawmill according to claim 7, wherein the main body member is a tube of constant rectangular cross-section and each guide member is a tube of constant rectangular cross-section.

10. A constructed sawhead for use as part of a constructed sawmill, said constructed sawmill having:

a bed defining a first translation axis;

a carriage, the carriage being mounted to the bed for movement along the first translation axis; and defining a second translation axis and a lateral axis, the second translation axis being orientated transverse to the first translation axis and the lateral axis being orientated transverse to each of the first translation axis and the second translation axis; and two or more elongate guide members secured to the carriage for movement therewith along the first translation axis, the guide members each being orientated parallel to the second translation axis and being spaced apart from one another in the direction of the lateral axis, constructed sawhead comprising:

two or more plates adapted to be stacked upon and secured to one another by bolts to form a plate stack; and two or more elongate guide receivers, each guide receiver having a longitudinal axis and an interior wall which defines a bore extending through said each guide receiver and through which said longitudinal axis extends, the interior wall having a cross-section which is substantially constant along the length of said each guide receiver, two or more guide receivers being adapted to be mounted to the plate stack by bolts at respective operative positions whereat the longitudinal axes are oriented parallel to one another and whereas the guide receivers are spaced from one another in a direction transverse to said axes.

11. A kit as claimed in claim 10, wherein said plate stack may be moved along said second translation axis by a slideable relation between said guide receivers and said guide members.

12. A kit for constructing a sawhead for use as part of a constructed sawmill, said constructed sawmill having:

a bed defining a first translation axis;

a carriage, the carriage being mounted to the bed for movement along the first translation axis; and defining a second translation axis and a lateral axis, the second translation axis being orientated transverse to the first translation axis and the lateral axis being orientated transverse to each of the first translation axis and the second translation axis; and two or more elongate guide members secured to the carriage for movement therewith along the first translation axis, the guide members each being orientated parallel to the second translation axis and being spaced apart from one another in the direction of the lateral axis, said kit comprising:

two or more guide receivers, each guide receiver, upon construction into an operable sawmill, being mounted to a respective one of the pair of guide members;

two or more plates, upon construction into an operable sawmill, extending parallel to said first translational axis, said plates, upon construction into an operable sawmill, stacked upon and secured to one another to form a plate stack, the plate stack, upon construction into an operable sawmill, being secured to each of the pair of guide receivers; and one or more reinforcing members sandwiched between the two or more plates in the plate stack and secured to the plates upon construction of the sawhead.

13. A kit according to claim 12, wherein upon construction of the sawhead, the plates are secured to one another by bolts, the reinforcing members are secured to the plates by bolts and the plate stack is secured to each of the two or more guide receivers by bolts.

14. A kit according to claim 12, further comprising a plurality of reinforcing members, said plurality of reinforcing members including a first pair of reinforcing members and a second pair of reinforcing members which, upon construction of the sawhead, are sandwiched between the plates in the plate stack and secured to the plates, the first pair being orientated parallel to the first translation axis and spaced apart from one another in the direction of the lateral axis and the second pair being disposed between the first pair, orientated parallel to the lateral axis and spaced apart from one another in the direction of the first translation axis.

15. A kit according to claim 14, wherein the reinforcing members are reinforcing tubes of rectangular cross-section.

16. A kit according to claim 15, wherein each plate has a central planar portion, a first flange and a second flange, the first flange and the second flange each extending from the central planar portion in a common direction and from opposite sides thereof; and upon construction of the sawhead, the first flanges of each of the plates extend toward and are aligned with one another and the second flanges of each of the plates extend toward and are aligned with one another.

17. A kit according to claim 16, wherein, upon construction of the sawhead, the first flanges of each of the plates lie against one end of each of the first pair of reinforcing members and the second flanges of each of the plates lie against the other end of each of the first pair of reinforcing tubes and the first flanges of each of the plates lie against one side of one of the second pair of reinforcing tubes.

18. A kit according to claim 12, wherein, the plates are provided with apertures which align in the plate stack to form two or more laterally spaced-apart throughpassing sockets; and the guide receivers each comprise an elongate main body member and a mounting flange extending around at least a portion of the periphery of the main body member at a longitudinally intermediate position;

and wherein, upon construction of the sawhead, each guide receiver is disposed at an operative position whereat its main body member is disposed in close-fitting relation in a respective socket and its mounting flange is disposed flush against a respective one of the plates, a plurality of bolts secure the plate stack to each of the pair of guide receivers, each bolt passing through a respective mounting flange, thence through the plate against which the mounting flange is disposed, thence through a respective one of the one or more reinforcing members, and thence into the other of the plates.

19. A kit according to claim 18, wherein the main body member is a tube of constant cross-section.

* * * * *